United States Patent [19]

Hayes

[11] Patent Number: 4,761,537

[45] Date of Patent: Aug. 2, 1988

[54] ELECTRIC BASEBOARD HEATER HAVING A REDUCED PROFILE CABINET

[75] Inventor: Edwin T. Hayes, Gray, Tenn.

[73] Assignee: Tennessee Plastics, Inc., Johnson City, Tenn.

[21] Appl. No.: 938,877

[22] Filed: Dec. 8, 1986

[51] Int. Cl.[4] ..... H05B 1/02; F24H 9/08; F24H 3/04

[52] U.S. Cl. ..... 219/366; 165/55; 219/365; 219/368; 219/374

[58] Field of Search ..... 219/365–368, 219/374, 341; 165/55

[56] References Cited

U.S. PATENT DOCUMENTS

| | | | |
|---|---|---|---|
| 2,799,763 | 7/1957 | Hicks | 219/366 X |
| 2,815,431 | 12/1957 | Paley | 219/366 |
| 3,020,382 | 2/1962 | Harrell | 219/366 X |
| 3,026,393 | 3/1962 | Quirk | 219/364 X |
| 3,084,240 | 4/1963 | Mast | 219/368 |
| 3,448,243 | 6/1969 | Ripple | 219/368 |
| 3,566,077 | 2/1971 | Steiner | 219/366 |
| 3,596,058 | 7/1971 | Steiner | 219/367 |
| 3,867,981 | 2/1975 | Monroe | 219/365 X |
| 4,149,065 | 4/1979 | Goff et al. | 219/368 X |

FOREIGN PATENT DOCUMENTS

| | | | |
|---|---|---|---|
| 1171447 | 7/1984 | Canada | 219/366 |

*Primary Examiner*—Anthony Bartis

[57] ABSTRACT

A reduced profile electric baseboard heater has an elongated, sheet metal shell, having top, upper floor, front, back, and lower floor sections defining a cabinet, the plane of the front and back being substantially parallel, the upper floor slanting downwardly from the back to the front, a removable end cap on each end of the shell, the plane of the lower floor in geometric association with the plane of the upper floor and front defining an electrical raceway, and the top, front, back and upper floor defining a heater element cavity overlying the raceway. A removable cover having floor, back and end walls is positioned in the raceway and encloses a portion thereof. An electric heating element positioned in the heater element cavity is controlled by a thermostat located in the raceway and enclosed by the cover.

12 Claims, 3 Drawing Sheets

ELECTRIC BASEBOARD HEATER HAVING A REDUCED PROFILE CABINET

This invention concerns electrical heaters, in particular perimeter baseboard heaters, and especially concerns a novel, compact cabinet for such heaters.

Heretofore, the cabinets of perimeter baseboard heaters have been constructed to provide at their ends the necessary electrical junction boxes for the electrical connections for the heater and for the controls to the house power lines. Such end located junction boxes necessarily increase the overall length of the heater without providing for any increase in length and capacity of the actual electrical resistance heating element. Many applications for such heaters require, or at least find desirable, a reduced profile heater to allow for furniture placement, closet space or the like, particularly in house trailers and other areas which place a premium on space conservation.

Principal objects therefore of the present invention are to provide a reduced profile (reduced cross-sectional) baseboard heater without compromising heating capacity, and to provide such heater without significant additional cost to the public. These and other objects hereinafter appearing have been attained in accordance with the present invention through the structure defined as a cabinet for a reduced profile perimeter base board electrical heater, the cabinet comprising an elongated sheet metal shell having interconnected sections comprising a top, upper floor, front, back, and lower floor, the planes of said front and back being substantially parallel, said upper floor slanting downwardly from said back to said front, a removable end cap on each end of said shell, each of said end caps having a base, the planes of said end cap bases and of said lower floor being substantially contiguous, the plane of said lower floor in geometric association with the plane of said upper floor, with the plane of said front, and with the plane of said back defining an electrical raceway, and said top, front, back and upper floor defining a heater element cavity overlying said raceway.

In further preferred embodiments of the invention:

(a) the slant angle of the upper floor is between about 15 and 45 degrees;

(b) the upper floor is interconnected to the front along a line spaced above the lower floor a distance equal to about 5% to 20% of the overall height of the front;

(c) the top provides a surface which slants upwardly from the back to the front at an angle between about 15 and 45 degrees;

(d) a support wall is provided adjacent each end of the cabinet spaced inwardly from the end caps and extending between the top, upper floor, front and back to provide a terminal cavity for a heater element wherein aperture means is provided in the upper floor to provide a continuum of the raceway for electrically connecting a heater element and control mechanism into the cabinet; and (e) the cabinet has an electrical heating element mounted lengthwise therein, a thermostat control mounted in the raceway, and manually operable means projecting through the floor of the cabinet and connected to the control for operating the same, the heating element and the control being electrically connected within the raceway, and the cover means in cooperation with contiguous portions of the cabinet substantially encloses the control.

As will become apparent from the specification and drawing description below, the relocation of the end junction boxes beneath the heater element cavity permits the utilization of the cavity space for extending the length of the resistance heating element. The heated air developed is thus cooler through using the full and extended cavity length. By spreading out the heat, the cabinet surface temperatures are lowered allowing thereby a smaller cross-sectional cabinet profile, thus using less material without loss of performance, which is commercially desirable.

The invention will be further understood from the following description and drawings wherein.

Figure 1:
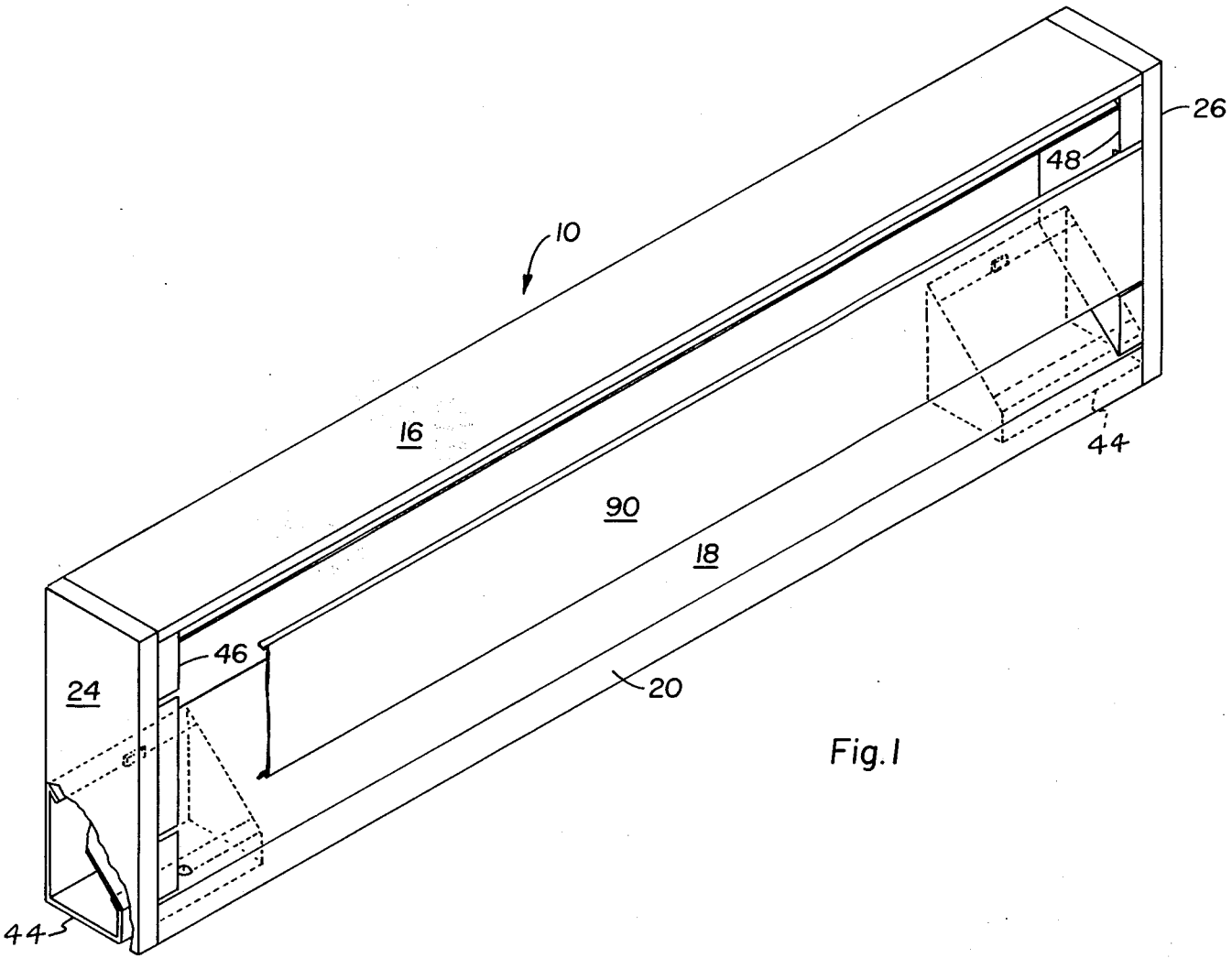
FIG. 1 is an isometric view of the heater cabinet with portions broken away and without the thermostat control in place.

Referring to the drawings, the invention comprises a cabinet generally designated 10 for a perimeter base board electrical heater generally designated 12, the cabinet comprising a shell generally designated 14 having a top 16, upper floor 18, front 20, back 22 and lower floor 23, the planes 36 and 38 of the front and back 20 and 22 respectively being substantially parallel, the upper floor slanting downwardly from the back to the front, removable end caps 24 and 26 on the ends of the shell, the end caps having bases 28 and 30 respectively, the common plane 32 of which lies substantially in the plane 31' of the lower floor 31, the plane of the lower floor in geometric association with the plane 34 of the upper floor 18, the plane 36 of the front 20 and the plane 38 of the back 22 defining an electrical raceway 40, generally open at the bottom in the embodiment shown, and the top 16, front 20, back 22, and upper floor 18 defining a heater element cavity 42 overlying the raceway.

The sections of the aforedescribed cabinet are preferably of sheet metal as is conventional for such cabinets and various means are available for connecting the sections together, including spot welding, brazing, sheet metal screws, bend over tabs, twist-lock tabs, and the like known to the fastening art. The embodiments of the invention described herein show exemplary ones of such fastening means and it is not applicant's intention to be limited thereby.

It is seen from the drawings that raceway 40 can be completely open at the back and at the bottom of the shell, and closed only at the ends by caps 24 and 26. As an alternative to such construction, one or more sheet metal or fire-proof plastic junction or control boxes or cover means generally designated 44 of any desired length, including the entire length of the raceway, may be provided to form, in cooperation with other portions the shell, a substantially enclosed space for housing electrical junctions, thermostat control or the like for both protection of the junctions and controls as well as for minimizing electrical and heat hazards.

Referring to FIGS. 2 and 4–8, heater element supports 46 and 48 are positioned adjacent opposite ends of the cabinet and are formed with grommet slots 50 and 52 respectively which provide shoulders 54 for slidably engaging in slots 56 in the edges of electrical and thermal insulating grommets 58 and 60. The necks 62 of these grommets, which typically are high temperature resistant plastic such as polyester or polycarbonate, support the ends 64 of the metal heater core 66 in which the resistance heater element 68, is contained. This element typically comprises a coiled, nickel-chromium alloy resistance heater wire imbedded in powdered magnesium oxide, and the metal core reduced tightly therearound. The electrical connections to this element are conveniently located within the grommet necks which are slid over the ends of the heater core in conventional manner. Supports 46 and 48 are conveniently attached to floor 18 by tabs 70 extending from the lower edges of the supports and through slots 72 in the floor, which tabs are then twisted to lock the supports in place. A safety heat sensor cut-off switch 74 is shown mounted on support 46 and carries a heat probe (not shown) extending into the heating area in conventional manner to provide a means for preventing excessive heat output of the heater element. A thermostat control 76 is conveniently located in the raceway or control box portion thereof with the control shaft 78 thereof extending through floor 18 and carrying control knob 80. Alternatively, shaft 78 could extend through support 46 and cap 24 such that knob 80 is positioned at the end of the cabinet.

It is particularly noted that in accordance with the present invention the fairly large body of control 76 is located in the raceway 40 and not at the end of the cabinet where it would necessitate lengthening thereof.

Figure 2:
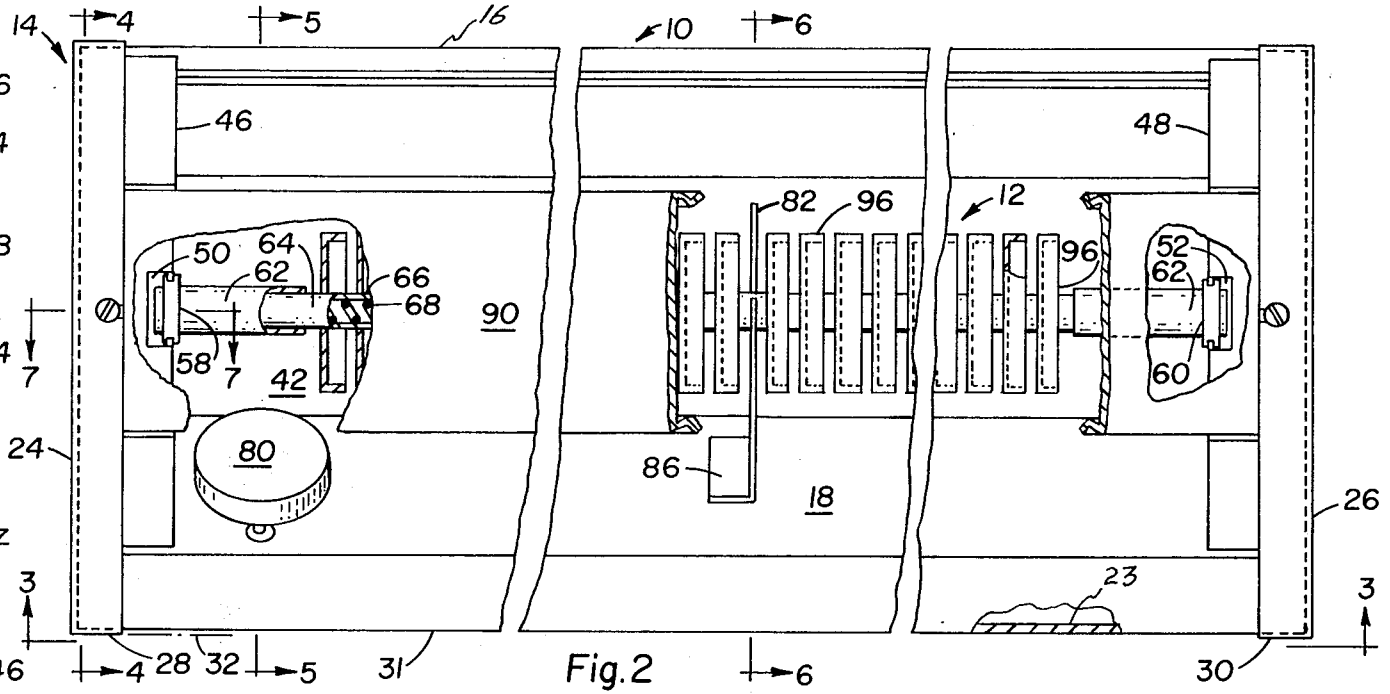
FIG. 2 is a front view of the heater cabinet with portions broken away and with the thermostat control in place.
Figure 3:
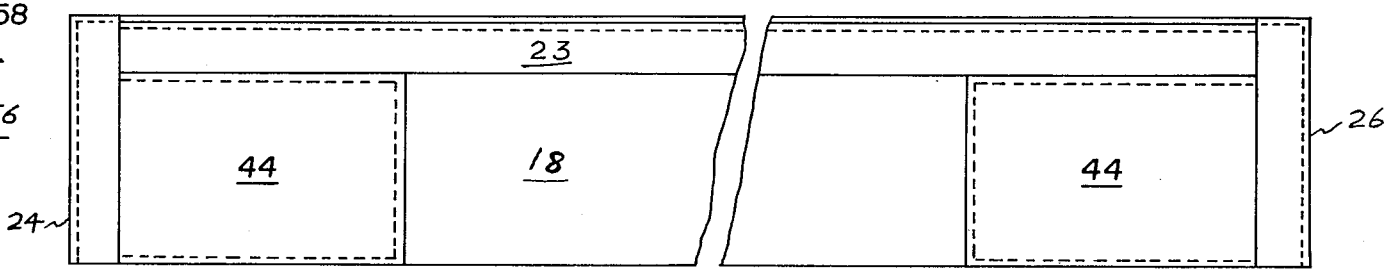
FIG. 3 is a bottom view of the heater cabinet taken along line 3—3 of FIG. 2 in the direction of the arrows.
Figure 8:
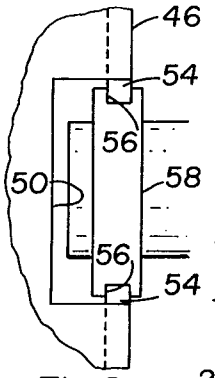
FIG. 8 is an enlarged view of the electrical grommet and its supporting structure of FIG. 2.
Figure 7:
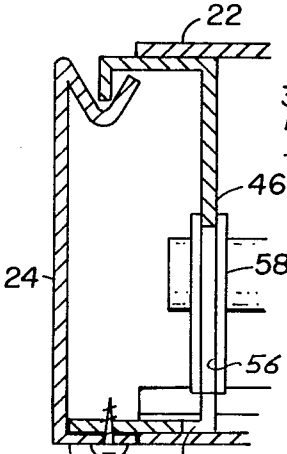
FIG. 7 is a longitudinal cross-sectional view of an end portion of the heater cabinet taken along line 7—7 of FIG. 2 in the direction of the arrows.
Figure 6:
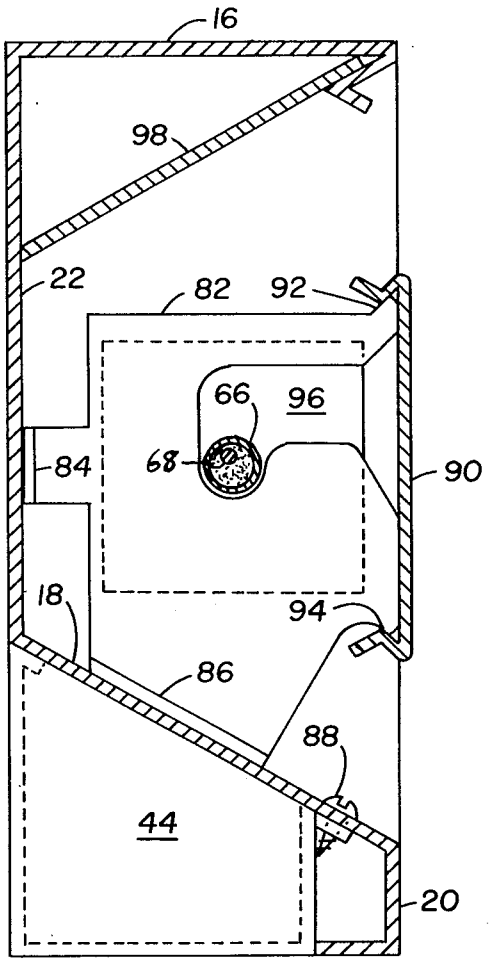
FIG. 6 is a sectional view of the heater cabinet taken along line 6—6 of FIG. 2 in the direction of the arrows.
Figure 5:
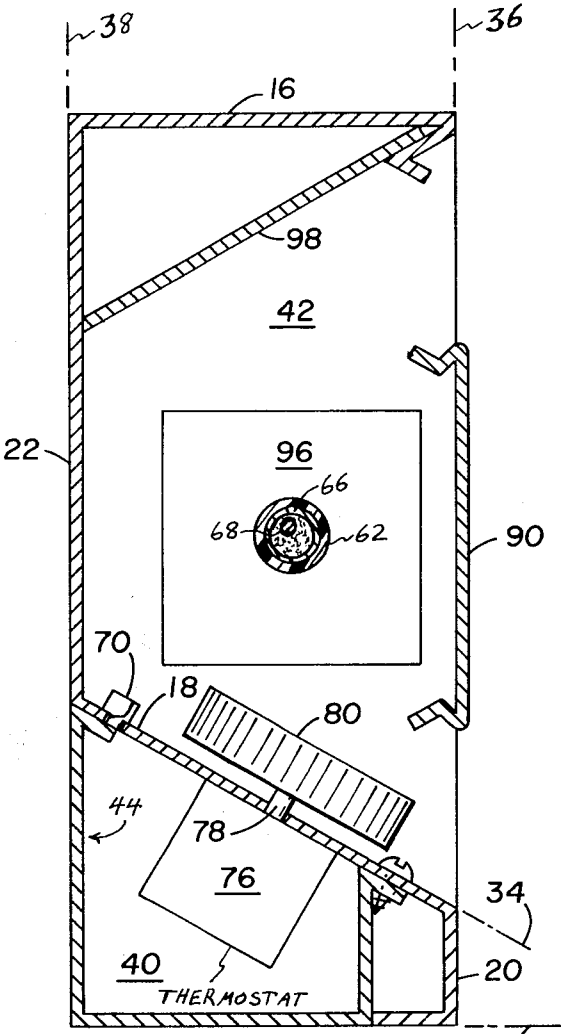
FIG. 5 is a sectional view of the heater cabinet taken along line 5—5 of FIG. 2 in the direction of the arrows.
Figure 4:
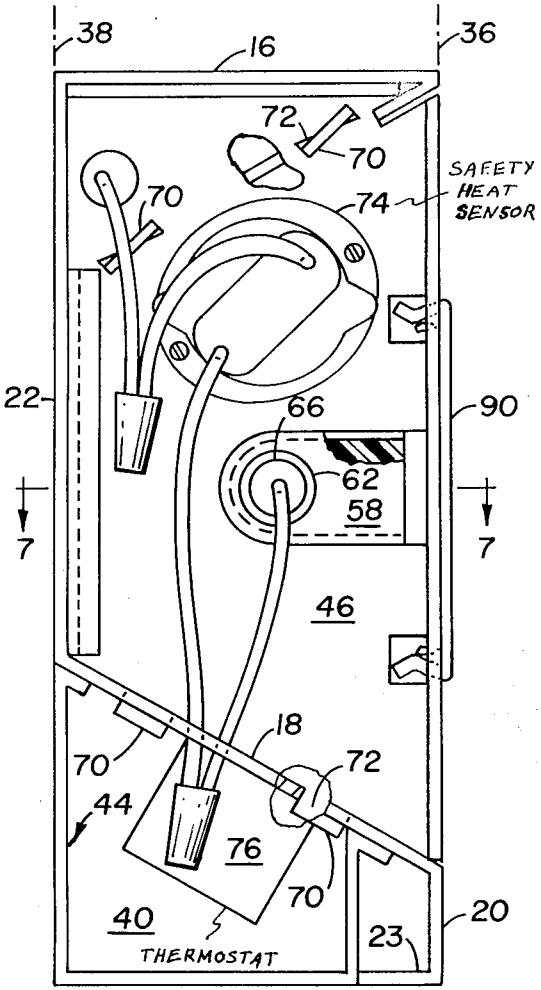
FIG. 4 is an end view of the heater cabinet with the end cap removed taken along line 4—4 of FIG. 2 in the direction of the arrows.

Referring to FIGS. 2 and 6, a heater element mid-support 82 is provided attached to back 22 and upper floor 18 by tabs 84 and 86 spot welded or the like thereto. The control boxes 44 also are secured to floor 18 by any suitable means such as the aforedescribed tabs and slots 70 and 72 and sheet metal screw 88. A front cover plate or baffle 90 is snapped over the outer shoulders 92 and 94 of mid-support 82 and provides a front portion of the cabinet which also shields the radiant heat fins 96 from direct exposure to the room area and to the room occupants. A top segment or roof 98 preferably is provided and extends between supports 46 and 48 and is connected thereto by means such as the aforementioned tabs 70 and slots 72. The configuration of the heater element cavity 42 provided by upper floor 18, back 22 and roof 98 has been found to provide exceptional heating efficiency.

The invention has been described in detail with particular reference to preferred embodiments thereof, but it will be understood that variations and modifications will be effected within the spirit and scope of this invention.

I claim:

1. A cabinet for a reduced profile perimeter base board electrical heater comprising an elongated sheet metal shell having interconnected sections comprising a top, upper floor, front, back, and lower floor, the planes of said front and back being substantially parallel, said upper floor slanting downwardly from said back to said front, a removable end cap on each end of said shell, each of said end caps having a base, the planes of said end cap bases and of said lower floor being substantially contiguous, the plane of said lower floor in geometric association with the plane of said upper floor, with the plane of said front, and with the plane of said back defining an electrical raceway, wherein said back terminates at its junction with said upper floor, and wherein said lower floor extends inwardly from said front only a minor portion of the width of said shell, the termination of said back and the minor extension of said lower floor providing easy access to said raceway, removable cover means positioned in said raceway and comprising a back, floor and end means enclosing at least a portion of said raceway, wherein the back and floor of said cover means lie substantially in the respective planes of the back and lower floor of said shell, and said top, front, back and upper floor of said shell defining a heater element cavity overlying said raceway.

2. The cabinet of claim 1 wherein the slant angle of said upper floor is between about 15 and 45 degrees.

3. The cabinet of claim 2 wherein said top provides a surface which slants upwardly from said back to said front at an angle between about 15 and 45 degrees.

4. The cabinet of claim 1 wherein said upper floor is interconnected to said front along a line spaced above the bottom edge of said front a distance equal to about 5% to 20% of the overall height of said front.

5. The cabinet of claim 1 wherein a support wall is provided adjacent each end of said cabinet spaced inwardly from said end caps and extending between said top, upper floor, front and back to provide a terminal cavity for a heater element.

6. The cabinet of claim 5 wherein aperture means in said upper floor provides a continuum of said raceway for electrically connecting a heater element into said cabinet.

7. The cabinet of claim 6 wherein the slant angle of said upper floor is between about 15 and 45 degrees.

8. The cabinet of claim 6 wherein said upper floor is interconnected to said front along a line spaced above the bottom edge of said front a distance equal to about 5% to 20% of the overall height of said front.

9. The cabinet of claim 6 wherein said top provides a surface which slants upwardly from said back to said front at an angle between about 15 and 45 degrees.

10. The cabinet of claim 6 wherein perimeter portions of said front define an opening to said heater element cavity.

11. The cabinet of claim 10 wherein a lengthwise baffle is provided across said opening.

12. An electric baseboard heater having a reduced profile elongated sheet metal shell having interconnected sections comprising a top, upper floor, front, back, and lower floor, the planes of said front and back being substantially parallel, said upper floor slanting downwardly from said back to said front, a removable end cap on each end of said shell, each of said end caps having a base, the planes of said end cap bases and of said lower floor being substantially contiguous, the plane of said lower floor in geometric association with the plane of said upper floor, with the plane of said front, and with the plane of said back defining an electrical raceway, said back terminating at its junction with said upper floor, and said lower floor extending inwardly from said front only a minor portion of the width of said shell, the termination of said back and the minor extension of said lower floor providing easy access to said raceway, removable cover means positioned in said raceway and comprising a back, floor and end means enclosing at least a portion of said raceway, wherein the back and floor of said cover means lie substantially in the respective planes of the back and lower floor of said shell, said top, front, back and upper floor of said shell defining a heater element cavity overlying said raceway, an electrical heating element mounted lengthwise in said heater element cavity of said shell, a thermostat control mounted in said raceway having manually operable control means projecting outwardly of said cabinet, said heating element and said thermostat control being electrically connected within said raceway, and said cover means in cooperation with contiguous portions of said cabinet substantially enclosing said thermostat control.

* * * * *